US011674103B2

(12) United States Patent
Duncan et al.

(10) Patent No.: US 11,674,103 B2
(45) Date of Patent: Jun. 13, 2023

(54) LUBRICANT BASE STOCK

(71) Applicant: Croda International Plc, Goole (GB)

(72) Inventors: Kevin John Duncan, Goole (GB); Paul Bonner, Goole (GB)

(73) Assignee: EQUUS UK TOPCO LTD, Goole (GB)

( * ) Notice: Subject to any disclaimer, the term of this patent is extended or adjusted under 35 U.S.C. 154(b) by 0 days.

(21) Appl. No.: 17/419,531

(22) PCT Filed: Jan. 22, 2020

(86) PCT No.: PCT/EP2020/051470
§ 371 (c)(1),
(2) Date: Jun. 29, 2021

(87) PCT Pub. No.: WO2020/152202
PCT Pub. Date: Jul. 30, 2020

(65) Prior Publication Data

US 2022/0081636 A1 Mar. 17, 2022

(30) Foreign Application Priority Data

Jan. 25, 2019 (GB) ..... 1901031

(51) Int. Cl.

| | |
|---|---|
| ***C10M 107/34*** | (2006.01) |
| *C10N 30/00* | (2006.01) |
| *C10N 20/00* | (2006.01) |
| *C10N 20/02* | (2006.01) |
| *C10N 20/04* | (2006.01) |
| *C10N 30/02* | (2006.01) |
| *C10N 30/06* | (2006.01) |
| *C10N 30/10* | (2006.01) |
| *C10N 30/12* | (2006.01) |
| *C10N 40/04* | (2006.01) |
| *C10N 40/08* | (2006.01) |

(52) U.S. Cl.
CPC .. *C10M 107/34* (2013.01); *C10M 2209/1045* (2013.01); *C10M 2209/1055* (2013.01); *C10N 2020/017* (2020.05); *C10N 2020/02* (2013.01); *C10N 2020/04* (2013.01); *C10N 2020/081* (2020.05); *C10N 2030/02* (2013.01); *C10N 2030/06* (2013.01); *C10N 2030/10* (2013.01); *C10N 2030/12* (2013.01); *C10N 2030/40* (2020.05); *C10N 2030/64* (2020.05); *C10N 2040/04* (2013.01); *C10N 2040/08* (2013.01)

(58) Field of Classification Search
CPC ..... C10N 107/34; C10N 2209/1045; C10N 2209/1055; C10N 2020/02; C10N 2020/04; C10N 2020/081; C10N 2030/06; C10N 2030/10; C10N 2030/12; C10N 2030/40; C10N 2030/64; C10N 2040/04; C10N 2040/08
See application file for complete search history.

(56) References Cited

U.S. PATENT DOCUMENTS

| | | | | |
|---|---|---|---|---|
| 5,576,275 | A * | 11/1996 | Moxey | C10M 107/46 568/624 |
| 7,666,822 | B2 | 2/2010 | Imai et al. | |
| 8,247,501 | B2 | 8/2012 | Greaves | |
| 10,968,412 | B2 * | 4/2021 | Sherman | C10M 169/041 |
| 2006/0217275 | A1 | 9/2006 | Imai et al. | |
| 2007/0004606 | A1 * | 1/2007 | da Costa | C10M 111/04 508/579 |
| 2008/0280791 | A1 * | 11/2008 | Hewette | C10M 167/00 508/516 |
| 2008/0312113 | A1 * | 12/2008 | Beatty | C10M 169/044 508/579 |
| 2010/0105803 | A1 * | 4/2010 | Bingeman | C10M 173/00 523/122 |
| 2010/0204075 | A1 | 6/2010 | da Costa | |
| 2010/0176333 | A1 * | 7/2010 | Tokiai | C10M 145/36 252/68 |
| 2013/0157909 | A1 * | 6/2013 | Greaves | C10M 105/14 508/513 |
| 2020/0190397 | A1 * | 6/2020 | Seymour-Loya | C09K 8/68 |
| 2021/0062103 | A1 * | 3/2021 | Horie | B23B 35/00 |
| 2021/0371768 | A1 * | 12/2021 | Greaves | C10M 173/02 |

FOREIGN PATENT DOCUMENTS

| | | | |
|---|---|---|---|
| WO | 2018057730 | A1 | 3/2018 |

OTHER PUBLICATIONS

Slade, "4.2 Water Soluble Lubricants", Handbook of Fiber Finish Technology, 1997, pp. 114-128.
International Search Report and Written Opinion for International Application No. PCT/EP2020/051470, dated Apr. 30, 2020, 10 pages.

* cited by examiner

*Primary Examiner* — Ellen M McAvoy

(57) ABSTRACT

The present invention relates to a lubricant base stock, lubricant formulations, a method of lubricating a rotating shaft within a stern tube and the use of a lubricant base stock. The base stock and lubricant formulations may be particularly suited for use in aqueous environments (including fresh water or salt water). A lubricant base stock comprising a first (EO)(PO)(EO) block co-polymer and a second (EO)(PO)(EO) block co-polymer which is different from the first (EO)(PO)(EO) block co-polymer in a marine lubricant formulation wherein the lubricant base stock has a density of at least 1028 kg/m$^3$ at 20° C. and at most 1022 kg/m$^3$ at 40° C. in particular is provided.

14 Claims, No Drawings

LUBRICANT BASE STOCK

CROSS-REFERENCE TO RELATED APPLICATIONS

This application is a U.S. National Phase application of PCT International Application No. PCT/EP2020/051470, filed Jan. 22, 2020, which claims the benefit of GB Application No. 1901031.3, filed Jan. 25, 2019, both of which are incorporated by reference herein in their entireties.

FIELD OF THE INVENTION

The present invention relates to a lubricant base stock, lubricant formulations, a method of lubricating a rotating shaft within a stern tube and the use of a lubricant base stock. The base stock and lubricant formulations may be particularly suited for use in freshwater, seawater or subsea environments. The base stock and lubricant formulations may be used in one or more marine lubricant applications such as stern tubes, thrusters, gears and hydraulics.

BACKGROUND

In the marine industry, some conventional lubricants may be considered as harmful to the environment. Recent regulations intend to improve the environmental profile of lubricants which may come into contact with fresh or sea water if accidentally discharged. A lubricant which causes a sheen on the surface of water it is discharged into may be considered as environmentally undesirable.

Some known polyalkylene glycol (PAG) base stocks comprise random polymers of propylene oxide (PO) and ethylene oxide (EO) monomers. These random polymers may not be considered to be environmentally friendly compounds due to low biodegradability. The discharging of these random PAG base stocks onshore or into the sea may increase the risk of harm to wildlife such as aquatic life present in the area.

Kobelco patent application US2006/0217275 discloses a lubricating oil for ship propulsor bearings comprising a low molecular weight PAG having a number average molecular weight not higher than 1000, and a water-soluble thickening agent having a number average molecular weight not lower than 10,000.

BASF patent application WO2018/057730 discloses marine lubricants comprising i) a biodegradable PAG, ii) an inherently biodegradable PAG and iii) a non-biodegradable PAG.

The presence of the non-biodegradable PAG may be considered to be environmentally unfriendly for the reasons discussed above.

It is an object of the present invention to address at least one of the disadvantages associated with the prior art.

SUMMARY OF THE INVENTION

The present invention is based in part on the recognition that a lubricant base stock comprising at least two (EO)(PO)(EO) block co-polymers may have beneficial properties. The block structure of the co-polymers may allow the base stock to partition between water solubility and insolubility depending on temperature. The presence of the different block co-polymers may allow the lubricant base stock to have a temperature variable density whereby the base stock is denser than seawater at a temperature below about 20° C. but is lighter than seawater at a temperature above about 40° C. This may be advantageous in that if the base stock is discharged into seawater at a temperature below about 20° C., it will not rise to cause an undesirable sheen on the surface of the water.

Thus viewed from a first aspect, the present invention provides a lubricant base stock comprising:

a) at least 10 wt % of a first polyalkylene glycol block co-polymer having an (EO)(PO)(EO) block structure and having a kinematic viscosity at 40° C. of at most 150 $mm^2/s$ (cSt); and b) at least 10 wt % of a second polyalkylene glycol block co-polymer having an (EO)(PO)(EO) block structure and having a kinematic viscosity at 40° C. different to that of the first polyalkylene glycol block co-polymer;

wherein the total wt % of polyalkylene glycol block co-polymers in the lubricant base stock is at least 87 wt %;

wherein the lubricant base stock comprises less than 8 wt % water; and wherein the lubricant base stock has a kinematic viscosity at 40° C. from 70 $mm^2/s$ (cSt) to 250 $mm^2/s$.

Viewed from a second aspect, the present invention provides a hydraulic or gear lubricant formulation comprising:

i) 50 wt % to 99 wt % of a lubricant base stock according to the first aspect;

ii) at least one anti-oxidant; and iii) at least one anti-wear additive.

Viewed from a third aspect, the present invention provides a stern tube lubricant formulation comprising:

i) 50 wt % to 99 wt % of a lubricant base stock according to the first aspect;

ii) at least one anti-oxidant; and iii) at least one corrosion inhibitor.

Viewed from a fourth aspect, the present invention provides a method of lubricating a rotating shaft within a stern tube on a marine vessel comprising the step of contacting the rotating shaft with a lubricant formulation comprising:

a) a first (EO)(PO)(EO) block co-polymer; and b) a second (EO)(PO)(EO) block co-polymer which is different from the first (EO)(PO)(EO) block co-polymer;

wherein the lubricant formulation has a density of at least 1028 $kg/m^3$ at 20° C. and at most 1022 $kg/m^3$ at 40° C.

Viewed from a fifth aspect, the present invention provides the use of a lubricant base stock comprising a first (EO)(PO)(EO) block co-polymer and a second (EO)(PO)(EO) block co-polymer which is different from the first (EO)(PO)(EO) block co-polymer in a marine lubricant formulation wherein the lubricant base stock has a density of at least 1028 $kg/m^3$ at 20° C. and at most 1022 $kg/m^3$ at 40° C.

Any or all of the features described herein may be combined in any aspect of the invention in any combination.

DETAILED DESCRIPTION

It will be understood that any upper or lower quantity or range limit used herein may be independently combined.

It will be understood that, when describing the number of carbon atoms in a substituent group (e.g. 'C1 to C6'), the number refers to the total number of carbon atoms present in the substituent group, including any present in any branched groups. Additionally, when describing the number of carbon atoms in, for example fatty acids, this refers to the total number of carbon atoms including the one at the carboxylic acid, and any present in any branch groups.

Polyalkylene Glycol Block Co-Polymers

The first and second polyalkylene glycol (PAG) block co-polymers have an (EO)(PO)(EO) block structure. Such polymers are also referred to herein as (EO)(PO)(EO) block co-polymers. The (EO) blocks of the polymers comprise at least one ethyleneoxy group, EO (—$C_2H_4O$—). An ethyleneoxy group may also be referred to as an ethylene oxide residue or equivalent. The (PO) block of the polymers comprises at least one propyleneoxy group, PO (—$C_3H_6O$—). A propyleneoxy group may also be referred to as a propylene oxide residue or equivalent. Where the number of ethyleneoxy groups and propyleneoxy groups is given for a compound, preferably this is the average number of groups per molecule in a sample of the compound.

The first PAG block co-polymer may have a number average molecular weight (Mn) of at least 1100 Da, preferably at least 1300 Da, more preferably at least 1500 Da. The first PAG block co-polymer may have a number average molecular weight of at most 9000 Da, preferably at most 7000 Da, more preferably at most 5000 Da, even more preferably at most 4000 Da. The second PAG block co-polymer may have a number average molecular weight (Mn) of at least 1800 Da, preferably at least 2000 Da, more preferably at least 2200 Da. The second PAG block co-polymer may have a number average molecular weight of at most 9000 Da, preferably at most 8000 Da, more preferably at most 6000 Da.

The ratio (higher:lower value) of the number average molecular weights of the first and second PAG block co-polymers may be at least 1.1:1, preferably at least 1.2:1, more preferably at least 1.3:1. The ratio of the number average molecular weights of the first and second PAG block co-polymers may be at most 8:1, preferably at most 6:1, more preferably at most 4:1.

The number average molecular weight and/or weight average molecular weight (Mw) may be determined by gel permeation chromatography (GPC). The calibration standards may be polystyrene standards. Suitable GPC settings are defined in the Examples herein.

The first PAG block co-polymer may have a weight average molecular weight (Mw) of at least 1200 Da, preferably at least 1400 Da, more preferably at least 1600 Da. The first PAG block co-polymer may have a weight average molecular weight of at most 9000 Da, preferably at most 7000 Da, more preferably at most 5000 Da, even more preferably at most 4000 Da. The second PAG block co-polymer may have a weight average molecular weight (Mw) of at least 2000 Da, preferably at least 2200 Da, more preferably at least 2400 Da. The second PAG block co-polymer may have a weight average molecular weight of at most 9000 Da, preferably at most 8000 Da, more preferably at most 6000 Da.

The first and/or second PAG block co-polymers may have a polydispersity index (Mw/Mn) of at least 1.01, preferably at least 1.02, more preferably at least 1.04. The first and/or second PAG block co-polymers may have a polydispersity index (Mw/Mn) of at most 2.5, preferably at most 2, more preferably at most 1.5, particularly at most 1.25, especially at most 1.2.

The first and/or second polyalkylene glycol block co-polymers may be initiated using an alkylene glycol, preferably propylene glycol, more preferably di-propylene glycol. After polymerisation, di-propylene glycol is equivalent to two propyleneoxy (PO) groups.

The kinematic viscosities of the first and/or second PAG block co-polymers may be measured according to the ASTM D7042 standard, preferably using an Anton Paar Stabinger SVM3001 Viscometer. The first block co-polymer may have a kinematic viscosity at 40° C. of at least 40 $mm^2/s$ (cSt), preferably at least 50, more preferably at least 60. The first block co-polymer has a kinematic viscosity at 40° C. of at most 150 $mm^2/s$ (cSt), preferably at most 140, more preferably at most 120, particularly at most 100. The second block co-polymer may have a kinematic viscosity at 40° C. of at least 80 $mm^2/s$ (cSt), preferably at least 90, more preferably at least 100. The second block co-polymer may have a kinematic viscosity at 40° C. of at most 300 $mm^2/s$ (cSt), preferably at most 280, more preferably at most 260.

The ratio (higher:lower value) of the kinematic viscosities at 40° C. of the first and second PAG block co-polymers may be at least 1.1:1, preferably at least 1.2:1, more preferably at least 1.3:1. The ratio of the kinematic viscosities at 40° C. of the first and second PAG block co-polymers may be at most 10:1, preferably at most 5:1, more preferably at most 4:1, particularly at most 3:1.

The pour point of the first and/or second PAG block co-polymers may be measured according to the ASTM D97 standard, preferably using an ISL MPP 5Gs automated pour point analyser. The pour point of the first and/or second polyalkylene glycol block co-polymer may be at most 0° C., preferably at most −10° C., more preferably at most −15° C., particularly at most −20° C.

The first and/or second PAG block co-polymers may be a compound of the general formula (I):

$$(EO)_p(PO)_q(EO)_r \quad (I)$$

where:

EO is an ethyleneoxy group;
PO is a propyleneoxy group;
p is from 1 to 15;
q is from 1 to 40; and
r is from 1 to 15;

The block co-polymers have a first ethyleneoxy block designated by $(EO)_p$ in formula (I). The value of p is from 1 to 15, meaning there are from 1 to 15 ethyleneoxy groups (or ethylene oxide equivalents) in the first ethyleneoxy block. Preferably p is at least 2, more preferably at least 3, yet more preferably at least 4, especially preferably at least 5.

Preferably p is at most 12, more preferably at most 10, yet more preferably at most 8. Preferably, p is from 3 to 12.

The block co-polymers have a propyleneoxy block designated by $(PO)_q$ in formula (I). The value of q is from 1 to 40, meaning there are from 1 to 40 propyleneoxy groups (or propylene oxide equivalents) in the propyleneoxy block. Preferably q is at least 2, more preferably at least 5, yet more preferably at least 8, especially preferably at least 10. Preferably q is at most 35, more preferably at most 30, yet more preferably at most 25. Preferably, q is from 10 to 30.

The block co-polymers have a second ethyleneoxy block designated by $(EO)_r$ in formula (I). The value of r is from 1 to 15, meaning there are from 1 to 15 ethyleneoxy groups (or ethylene oxide equivalents) in the second ethyleneoxy block. Preferably r is at least 2, more preferably at least 3, yet more preferably at least 4, especially preferably at least 5. Preferably r is at most 12, more preferably at most 10, yet more preferably at most 8. Preferably, r is from 3 to 12.

The ethyleneoxy blocks and propyleneoxy blocks may contain minor proportions of other alkyleneoxy groups. For example, the propyleneoxy section may include minor proportions of butyleneoxy groups. The minor proportion of such other alkyleneoxy units may not be more than 10 mol % and is preferably not more than 5 mol % of the total alkyleneoxy groups in the respective section.

Preferably the first and/or second PAG block co-polymers satisfy the biodegradability requirements set forth in the Organization for Economic Co-operation and Development standard 301B (OECD 301B) which applies for fresh water. Preferably the first and/or second PAG block co-polymers satisfy the biodegradability requirements set forth in OECD 306B which applies for sea water. Preferably the first and/or second PAG block co-polymers satisfy the non-bioaccumulative requirements set forth in OECD 107.

Lubricant Base Stock

The lubricant base stock of the invention comprises:

a) at least 10 wt % of a first polyalkylene glycol block co-polymer having an (EO)(PO)(EO) block structure and having a kinematic viscosity at 40° C. of at most 150 $mm^2/s$ (cSt); and b) at least 10 wt % of a second polyalkylene glycol block co-polymer having an (EO)(PO)(EO) block structure and having a kinematic viscosity at 40° C. different to that of the first polyalkylene glycol block co-polymer;

wherein the total wt % of polyalkylene glycol block co-polymers in the lubricant base stock is at least 87 wt %;

wherein the lubricant base stock comprises less than 8 wt % water; and wherein the lubricant base stock has a kinematic viscosity at 40° C. from 70 $mm^2/s$ (cSt) to 250 $mm^2/s$.

The lubricant base stock may comprise at least 15 wt %, preferably at least 20 wt %, more preferably at least 25 wt % of the first polyalkylene glycol block co-polymer. The lubricant base stock may comprise at most 90 wt %, preferably at most 85 wt %, more preferably at most 80 wt % of the first polyalkylene glycol block co-polymer. The lubricant base stock may comprise at least 15 wt %, preferably at least 20 wt %, more preferably at least 25 wt % of the second polyalkylene glycol block co-polymer. The lubricant base stock may comprise at most 90 wt %, preferably at most 85 wt %, more preferably at most 80 wt % of the second polyalkylene glycol block co-polymer.

Preferably the total wt % of polyalkylene glycol block co-polymers in the lubricant base stock is at least 90 wt %, more preferably at least 95 wt %.

Preferably the lubricant base stock comprises less than 10 wt % of polyalkylene glycol random co-polymer, more preferably less than 8 wt %, more preferably less than 6 wt %, particularly less than 4 wt %. The lubricant base stock may be essentially free of polyalkylene glycol random co-polymer.

Preferably the lubricant base stock comprises less than 10 wt % of polyalkylene glycol homo-polymer, more preferably less than 8 wt %, more preferably less than 6 wt %, particularly less than 4 wt %. The lubricant base stock may be essentially free of polyalkylene glycol homo-polymer. The lubricant base stock may not comprise a polyethylene glycol.

Preferably the lubricant base stock comprises less than 7 wt % water, more preferably less than 5 wt %, particularly less than 3 wt %, desirably less than 1 wt %. The lubricant base stock may be non-aqueous or essentially free of water or anhydrous.

The lubricant base stock may be essentially free of Group I, II and III base oils, as classified according to the American Petroleum Institute (API) Base Oil Interchangeability Guidelines. The lubricant base stock may comprise a Group IV or V base oil, preferably a Group V base oil, more preferably one or more esters.

Preferably the lubricant base stock has a density of at least 1028 $kg/m^3$ at 20° C., more preferably at least 1029 $kg/m^3$ at 20° C. Preferably the lubricant base stock has a density of at most 1022 $kg/m^3$ at 40° C., more preferably at most 1021 $kg/m^3$ at 40° C.

Preferably the lubricant base stock is insoluble when added at 1 wt % to seawater, preferably synthetic seawater as defined in the Examples, at a temperature of at least 40° C., preferably at least 35° C., more preferably at least 30° C.

Preferably the lubricant base stock does not comprise a non-biodegradable polyalkylene glycol as defined by OECD 301B. Preferably the lubricant base stock does not comprise a non-biodegradable polyalkylene glycol as defined by OECD 306B. Preferably the lubricant base stock has a fresh water biodegradability as defined by OECD 301B of at least 60%, preferably at least 70%, more preferably at least 80%. Preferably the lubricant base stock has a seawater biodegradability as defined by OECD 306B of at least 60%, preferably at least 70%, more preferably at least 80%.

Preferably the lubricant base stock is suitable for use in marine environments, such as fresh water, sea water or sub-sea environments, more preferably the lubricant base stock is suitable for use in environments involving contact with sea water. The lubricant base stock may be suitable for use in one or more marine lubricant applications such as stern tubes, thrusters, gears and hydraulics, preferably stern tubes, gears and hydraulics, more preferably stern tubes.

Lubricant Additives and Formulations

Lubricant additives may be added to the lubricant base stock of the invention to form a lubricant formulation. The lubricant formulation may comprise an additive pack.

Representative amounts of lubricant additives in the lubricant formulation are as follows. Wt % ranges are given on the basis of the total weight of the lubricant formulation. Any combination of these additives and their broad and preferred wt % ranges may be incorporated in the present invention.

| Additive | (Broad) Wt. % | (Preferred) Wt. % |
|---|---|---|
| Corrosion Inhibitors | 0.01-3 | 0.02-1 |
| Anti-oxidants | 0.01-6 | 0.01-3 |
| Anti-foaming Agents | 0.001-5 | 0.001-0.5 |
| Anti-wear Additives | 0.001-5 | 0.2-3 |
| Pour Point Depressants | 0.01-2 | 0.01-1.5 |
| Seal Swellants | 0.1-8 | 0.5-5 |
| Base Stock | Balance | Balance |

1. Corrosion inhibitors may comprise one or more of: fatty acid esters, salts and/or soaps, alkanolamines such as dimethylethanolamine or 1-amino-2-propanol, condensation products of an alkyl succinic acid or anhydride and/or a fatty acid with a polyamine and sarcosine derivatives such as oleyl sarcosine.

2. Anti-oxidants may comprise one or more of: phenol type (phenolic) oxidation inhibitors, such as 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butyl-phenol), 4,4'-butylidene-bis(3-methyl-6-tert-butylphenol), 4,4'-isopropylidene-bis(2,6-di-tert-butylphenol), 2,2'-methylene-bis(4-methyl-6-nonylphenol), 2,2'-isobutylidene-bis(4,6-dimethylphenol), 2,2'-methylene-bis(4-methyl-6-cyclohexylphenol), 2,6-di-tert-butyl-4-methylphenol, 2,6-di-tert-butyl-4-ethylphenol, 2,6-di-tert-butylphenol, 2,4-dimethyl-6-tert-butyl-phenol, 2,6-di-tert-1-dimethylamino-p-cresol, 2,6-di-tert-4-(N,N'-dimethylamino-methylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis(3, 5-di-tert-butyl-4-hydroxybenzyl). Anti-oxidants may also comprise one or more of alkylated diphenylamines (e.g., Irganox L-57 from BASF), metal dithiocarbamate (e.g., zinc dithiocarbamate), methylene-bis(dibutyldithiocarbamate), Irganox L-107 or L-109.

3. Anti-foaming agents may comprise one or more of: (meth)acrylate polymers, alkyl-(meth)acrylate polymers, silicone polymers and dimethyl silicone polymers.

4. Anti-wear additives may comprise one or more of: phosphates, phosphites, carbamates, esters, sulfur containing compounds, and molybdenum complexes. Preferred are phosphorus-containing anti-wear/extreme pressure agents comprise metal thiophosphates, phosphoric acid esters and salts thereof, phosphorus-containing carboxylic acids, esters, ethers, and amides; and phosphites. In certain embodiments a phosphorus anti-wear agent may be present in an amount to deliver 0.01 to 0.2 or 0.015 to 0.15 or 0.02 to 0.1 or 0.025 to 0.08 weight percent phosphorus in the total lubricant formulation. A preferred anti-wear agent is a zinc dialkyldithiophosphate (ZDDP) which is preferably selected from primary alkyl, secondary alkyl, and/or aryl type. Non-phosphorus-containing anti-wear agents include borate esters, borated epoxides, dithiocarbamate compounds, molybdenum-containing compounds, and sulfurized olefins.

5. Pour point depressants may comprise one or more of: polyalphaolefins, esters of maleic anhydride-styrene copolymers, poly(meth)acrylates, or polyacrylamides.

6. Seal swellants may comprise one or more of: esters, amides or sulfolene derivatives. Examples of seal swellants include Exxon Necton-37™ (FN 1380) and Exxon Mineral Seal Oil™ (FN 3200).

The lubricant formulation may be suitable for use in marine environments, such as fresh water, sea water or sub-sea environments, more preferably the lubricant formulation is suitable for use in environments involving contact with sea water. The lubricant formulation may be suitable for use in one or more marine lubricant applications such as stern tubes, thrusters, gears and hydraulics, preferably stern tubes, gears and hydraulics, more preferably stern tubes. Preferably the lubricant formulation is a marine lubricant formulation.

Preferably the lubricant formulation has a density of at least 1028 kg/m$^3$ at 20° C., more preferably at least 1029 kg/m$^3$ at 20° C. Preferably the lubricant formulation has a density of at most 1022 kg/m$^3$ at 40° C., more preferably at most 1021 kg/m$^3$ at 40° C.

Preferably the lubricant formulation is insoluble when added at 1 wt % to seawater, preferably synthetic seawater as defined in the Examples, at a temperature of at least 40° C., preferably at least 35° C., more preferably at least 30° C.

The invention provides a hydraulic or gear lubricant formulation comprising:

i) 50 wt % to 99 wt % of a lubricant base stock as defined herein;

ii) at least one anti-oxidant; and iii) at least one anti-wear additive.

The hydraulic or gear lubricant formulation may comprise at least 0.01 wt % anti-oxidant, preferably at least 0.05 wt %, more preferably at least 0.1 wt %. The hydraulic or gear lubricant formulation may comprise at most 6 wt % anti-oxidant, preferably at most 4 wt %, more preferably at most 3 wt %. The anti-oxidant may be selected from those described herein.

The hydraulic or gear lubricant formulation may comprise at least 0.01 wt % anti-wear additive, preferably at least 0.05 wt %, more preferably at least 0.1 wt %, particularly at least 0.2 wt %. The hydraulic or gear lubricant formulation may comprise at most 5 wt % anti-wear additive, preferably at most 4 wt %, more preferably at most 3 wt %. The anti-wear additive may be selected from those described herein.

The invention provides a stern tube lubricant formulation comprising:

i) 50 wt % to 99 wt % of a lubricant base stock as defined herein;

ii) at least one anti-oxidant; and iii) at least one corrosion inhibitor.

The stern tube lubricant formulation may comprise at least 0.01 wt % anti-oxidant, preferably at least 0.05 wt %, more preferably at least 0.1 wt %. The stern tube lubricant formulation may comprise at most 6 wt % anti-oxidant, preferably at most 4 wt %, more preferably at most 3 wt %. The anti-oxidant may be selected from those described herein.

The stern tube lubricant formulation may comprise at least 0.01 wt % corrosion inhibitor, preferably at least 0.02 wt %. The stern tube lubricant formulation may comprise at most 3 wt % corrosion inhibitor, preferably at most 2 wt %, more preferably at most 1 wt %. The corrosion inhibitor may be selected from those described herein.

Method of Lubricating

The invention provides a method of lubricating a rotating shaft within a stern tube on a marine vessel comprising the step of contacting the rotating shaft with a lubricant formulation comprising:

a) a first (EO)(PO)(EO) block co-polymer; and b) a second (EO)(PO)(EO) block co-polymer which is different from the first (EO)(PO)(EO) block co-polymer;

wherein the lubricant formulation has a density of at least 1028 kg/m$^3$ at 20° C. and at most 1022 kg/m$^3$ at 40° C.

The lubricant formulation may comprise a lubricant base stock as described herein. The lubricant formulation and the lubricant base stock may have any of the features described herein.

Use of a Lubricant Base Stock

The invention provides the use of a lubricant base stock comprising a first (EO)(PO)(EO) block co-polymer and a second (EO)(PO)(EO) block co-polymer which is different from the first (EO)(PO)(EO) block co-polymer in a marine lubricant formulation wherein the lubricant base stock has a density of at least 1028 kg/m$^3$ at 20° C. and at most 1022 kg/m$^3$ at 40° C.

The marine lubricant formulation may comprise a lubricant base stock as described herein. The marine lubricant formulation and the lubricant base stock may have any of the features described herein.

Any or all of the features described herein may be combined in any aspect of the invention in any combination.

EXAMPLES

The invention is illustrated by the following non-limiting examples. All parts and percentages are given by weight unless otherwise stated. All tests and physical properties herein have been determined at atmospheric pressure and room temperature (i.e. about 20° C.), unless otherwise stated herein, or unless otherwise stated in the referenced test methods and procedures.

Test Methods a) Kinematic viscosity was measured according to the ASTM D7042 standard using an Anton Paar Stabinger SVM3001 Viscometer. It is noted that these results will be equivalent to results obtained following ASTM D445. The difference between these standards is mainly in the type of measurement apparatus used.

b) Viscosity Index was measured according to ASTM D2270 using an Anton Paar Stabinger SVM3001 Viscometer.

c) Density was measured according to ASTM D4052 using an Anton Paar Stabinger SVM3001 Viscometer.

d) Pour point was measured according to ASTM D97 using an Integrated Scientific Limited MPP5G automated pour point analyser.

e) Cloud point is defined as the temperature above which a 1 wt % aqueous solution of the sample changes from clear to turbid, indicating the sample is no longer soluble in the solution.

f) Number average molecular weight was measured by Gel Permeation Chromatography (GPC). The apparatus and settings used for the GPC are given below in Example 1.

Example 1

Di-propylene glycol initiated (EO)(PO)(EO) block co-polymers A, B and C were obtained from the raw materials given in Table 1.

TABLE 1

Composition of polymers A, B and C

| | Ethylene Oxide (wt %) | Propylene Oxide (wt %) | Di-Propylene Glycol (wt %) |
|---|---|---|---|
| Block co-polymer A | 14.3 | 74.7 | 11.0 |
| Block co-polymer B | 27.5 | 65.4 | 7.1 |
| Block co-polymer C | 30.3 | 64.3 | 4.4 |

Polymers A, B and C have Kinematic viscosity at 40° C., measured as described in the Test Methods section, as shown in Table 2.

TABLE 2

Kinematic viscosity at 40° C.

| | Kinematic viscosity at 40° C. ($mm^2/s$) |
|---|---|
| Block co-polymer A | 76 |
| Block co-polymer B | 135 |
| Block co-polymer C | 204 |

It can be seen from Table 2 that the ratios (higher:lower value) of the kinematic viscosities at 40° C. of polymers A, B and C are all less than 5:1.

Number average molecular weight of the polymers were measured in Daltons (Da) by Gel Permeation Chromatography (GPC). The apparatus and settings used for the GPC were:

Instrument: Agilent 1260
Columns: PLgel guard and 2×PLgel 5 μm mixed D columns 300×7.5 mm
Solvent: Tetrahydrofuran
Flow-rate: 1.0 mL/min
Injection volume: 50 μl
Temperature: 40° C.
Detector: Refractive Index.
Run time: 30 minutes The GPC was calibrated using polystyrene standards. The data was collected and analysed using Agilent software. The results of the GPC analysis are given in Table 3.

TABLE 3

Molecular Weight

| | Number average molecular weight, Mn (Da) |
|---|---|
| Block co-polymer A | 1528 |
| Block co-polymer B | 2508 |
| Block co-polymer C | 3479 |

It can be seen from Table 3 that the ratios (higher:lower value) of the number average molecular weights of polymers A, B and C are all less than 8:1.

Example 2

Block co-polymers A, B and C were blended by weight percentage (wt %) as shown in Table 4 to make Samples 1 and 2.

TABLE 4

Composition of Samples 1 & 2

| | Sample 1 | Sample 2 |
|---|---|---|
| Block co-polymer A (wt %) | 51.2 | 0 |
| Block co-polymer B (wt %) | 49.8 | 73.8 |
| Block co-polymer C (wt %) | 0 | 26.2 |

Samples 1 & 2 have physical characteristics, measured as described in the Test Methods section, as shown in Table 5.

TABLE 5

Physical characteristics of Samples 1 & 2

| | Sample 1 | Sample 2 |
|---|---|---|
| Kinematic viscosity, at 40° C. ($mm^2/s$) | 105 | 152 |
| Kinematic viscosity, at 100° C. ($mm^2/s$) | 17 | 25 |
| Viscosity Index | 180 | 198 |
| Pour point, (° C.) | −42 | −24 |
| Cloud point at 1 wt % in synthetic seawater (° C.) | 29* | 27* |

*above this temperature, the sample is insoluble in synthetic seawater

Example 3

Synthetic seawater was made by adding salts to deionised water according to Table 6. Samples 1 & 2 were then tested in combination with the synthetic seawater.

TABLE 6

Synthetic Seawater

| Salt | g/kg solution (gravimetric) |
|---|---|
| Sodium chloride | 23.926 |
| Sodium sulphate | 4.008 |
| Potassium chloride | 0.677 |

TABLE 6-continued

| Synthetic Seawater | |
|---|---|
| Salt | |
| Sodium bicarbonate | 0.196 |
| Potassium bromide | 0.098 |
| Boric acid | 0.026 |
| Sodium fluoride | 0.003 |
| | mol/kg solution (volumetric) |
| Magnesium chloride | 0.05327 |
| Calcium chloride | 0.01033 |
| Strontium chloride | 0.00009 |

Samples 1 & 2 were mixed with the synthetic seawater of Table 6 and the kinematic viscosity at 40° C. was tested as described in the Test Methods. The results are shown in Table 7.

TABLE 7

| Variation in Kinematic Viscosity | | |
|---|---|---|
| Amount of synthetic seawater in mixture with Sample | Kinematic viscosity, ($mm^2/s$) at 40° C. | |
| (wt %) | Sample 1 | Sample 2 |
| 0 | 105 | 152 |
| 5 | 107 | 157 |
| 10 | 102 | 160 |
| 20 | 91 | 168 |

It can be seen from Table 7 that Samples 1 & 2 can withstand the addition of a significant amount (up to 20 wt %) of synthetic seawater without a large variation in their kinematic viscosity at 40° C. The kinematic viscosity of Sample 1 with 20 wt % seawater is 87% of the value without seawater. The kinematic viscosity of Sample 2 with 20 wt % seawater is 111% of the value without seawater. As can be seen from Table 5, 40° C. is above the cloud point of both Sample 1 and Sample 2 and so the samples are insoluble in synthetic seawater at this temperature. By contrast, if the samples were water soluble at this temperature, then a larger variation in viscosity would be expected since the samples would readily mix and interact with the water.

The variation with temperature of Samples 1, 2 and the synthetic seawater was investigated. Density was measured according to the Test Methods and the results are given in Table 8.

The solubility or insolubility of Sample 1 and Sample 2 at 1 wt % in synthetic seawater is also shown in Table 8 and this information is related to the cloud points of the samples shown in Table 5.

TABLE 8

| Change in solubility and density with temperature | | | | | |
|---|---|---|---|---|---|
| Temperature (° C.) | Solubility of 1 wt % of Sample 1 in synthetic seawater | Solubility of 1 wt % of Sample 2 in synthetic seawater | Sample 1 Density ($kg/m^3$) | Sample 2 Density ($kg/m^3$) | Synthetic Seawater Density ($kg/m^3$) |
| 5 | Soluble | Soluble | 1041 | 1049 | 1031 |
| 10 | Soluble | Soluble | 1037 | 1045 | 1030 |
| 15 | Soluble | Soluble | 1033 | 1041 | 1029 |
| 20 | Soluble | Soluble | 1029 | 1037 | 1028 |
| 25 | Soluble | Soluble | 1025 | 1033 | 1026 |
| 30 | Insoluble | Insoluble | 1022 | 1029 | 1025 |
| 35 | Insoluble | Insoluble | 1018 | 1026 | 1023 |
| 40 | Insoluble | Insoluble | 1014 | 1021 | 1022 |

It can be seen from Table 8 that Sample 1 is denser than synthetic seawater at 20° C. Sample 2 is denser than seawater at 35° C. This may be advantageous since ambient seawater temperatures very rarely exceed 35° C. and often do not exceed 20° C. around the world. Without being bound by theory, Samples 1 & 2 and lubricant formulations which include them as a base stock are unlikely to float or sheen on the surface of the water if accidentally discharged into a marine environment. This is due to the samples being denser than the surrounding water. It can also be seen from Table 8 that both Samples 1 & 2 are less dense than seawater at 40° C. Without being bound by theory, this can be advantageous in a lubricant formulation for a stern tube on a marine vessel since such stern tubes are likely to have an operating temperature greater than 40° C. Therefore, if seawater enters such a stern tube during operation, the lubricant formulation will float on the seawater in a similar way to a conventional mineral oil based lubricant. This will allow the water trap system in a conventional stern tube to remove the water, which is desirable since seawater is very corrosive. The removal of water is also assisted by the samples being insoluble in water above 30° C. This means that this lubricant base stock can be used without modification to the stern tube.

It is to be understood that the invention is not to be limited to the details of the above embodiments, which are described by way of example only. Many variations are possible.

The invention claimed is:

1. A lubricant base stock comprising:

a) at least 10 wt % of a first polyalkylene glycol block co-polymer having an (EO)(PO)(EO) block structure and having a kinematic viscosity at 40° C. of at most 150 $mm^2/s$ (cSt); and b) at least 10 wt % of a second polyalkylene glycol block co-polymer having an (EO)(PO)(EO) block structure and having a kinematic viscosity at 40° C. different to that of the first polyalkylene glycol block co-polymer;

wherein the total wt % of polyalkylene glycol block co-polymers in the lubricant base stock is at least 87 wt %;

wherein the lubricant base stock comprises less than 8 wt % water;

wherein the lubricant base stock has a kinematic viscosity at 40° C. from 70 $mm^2/s$ (cSt) to 250 $mm^2/s$; and wherein the lubricant base stock is insoluble when added at 1 wt % to seawater at a temperature of at least 40° C.

2. A lubricant base stock according to claim 1 wherein the ratio of the number average molecular weights of the first and second polyalkylene glycol block co-polymers is at most 8:1.

3. A lubricant base stock according to claim 1 wherein the ratio of the kinematic viscosities at 40° C. of the first and second polyalkylene glycol block co-polymers is at most 5:1.

4. A lubricant base stock according to claim 1 comprising less than 10 wt % of polyalkylene glycol random co-polymer.

5. A lubricant base stock according to claim 1 comprising less than 10 wt % of polyalkylene glycol homo-polymer.

6. A lubricant base stock according to claim 1 which does not comprise a non-biodegradable polyalkylene glycol as defined by Organization for Economic Cooperation and Development Standard 301B (OECD 301B).

7. A lubricant base stock according to claim 1 which has a seawater biodegradability as defined by OECD 306B of at least 60%.

8. A lubricant base stock according to claim 1 which has a density of at least 1028 kg/m$^3$ at 20° C. and at most 1022 kg/m$^3$ at 40° C.

9. A hydraulic or gear lubricant formulation comprising:
i) 50 wt % to 99 wt % of a lubricant base stock according to claim 1;
ii) at least one anti-oxidant; and
iii) at least one anti-wear additive.

10. A stern tube lubricant formulation comprising:
i) 50 wt % to 99 wt % of a lubricant base stock according to claim 1;
ii) at least one anti-oxidant; and
iii) at least one corrosion inhibitor.

11. The lubricant base stock of claim 1, wherein the lubricant base stock is insoluble when added at 1 wt % to seawater at a temperature of at least 35° C.

12. The lubricant base stock of claim 1, wherein the lubricant base stock is insoluble when added at 1 wt % to seawater at a temperature of at least 30° C.

13. A method of lubricating a rotating shaft within a stern tube on a marine vessel comprising the step of contacting the rotating shaft with a lubricant formulation comprising:
a) a first (EO)(PO)(EO) block co-polymer; and
b) a second (EO)(PO)(EO) block co-polymer which is different from the first (EO)(PO)(EO) block co-polymer;
wherein the lubricant formulation has a density of at least 1028 kg/m$^3$ at 20° C. and at most 1022 kg/m$^3$ at 40° C., and
wherein the lubricant formulation is insoluble when added at 1 wt % to seawater at a temperature of at least 40° C.

14. A marine lubricant formulation comprising a lubricant base stock comprising a first (EO)(PO)(EO) block co-polymer and a second (EO)(PO)(EO) block co-polymer which is different from the first (EO)(PO)(EO) block co-polymer, wherein the lubricant base stock has a density of at least 1028 kg/m$^3$ at 20° C. and at most 1022 kg/m$^3$ at 40° C., and wherein the lubricant base stock is insoluble when added at 1 wt % to seawater at a temperature of at least 40° C.

* * * * *